United States Patent [19]

Yamamoto et al.

[11] 4,408,641

[45] Oct. 11, 1983

[54] APPARATUS FOR FILLING VISCOUS SUBSTANCES INTO HARD GELATIN CAPSULES

[75] Inventors: Taizo Yamamoto, Osaka; Tetsuhisa Ishida, Ando, both of Japan

[73] Assignee: Nippon Elanco Kabushiki Kaisha, Osaka, Japan

[21] Appl. No.: 265,054

[22] Filed: May 19, 1981

[30] Foreign Application Priority Data

May 22, 1980 [JP] Japan ..... 55-68636

[51] Int. Cl.[3] ..... B65B 43/60

[52] U.S. Cl. ..... 141/82; 141/168; 141/283; 198/489; 198/631; 222/236

[58] Field of Search ..... 141/69, 82, 168, 170, 141/183, 283; 198/480, 489, 631; 222/236

[56] References Cited

U.S. PATENT DOCUMENTS 4,051,878 10/1977 Ohmeis et al. ..... 141/150 X 4,192,361 3/1980 Moser ..... 141/82

*Primary Examiner*—Frederick R. Schmidt

*Attorney, Agent, or Firm*—Birch, Stewart, Kolasch & Birch

[57] ABSTRACT

An apparatus for filling viscous substances into hard gelatin capsules, while heating and stirring the viscous substances to be filled. The apparatus is entirely simplified in construction, reliable in operation and inexpensive. The apparatus includes a hopper, a pumping mechanism and a capsule body loading board being operatively connected with respect to each other. A reciprocating feed mechanism transfers the capsule body loading board from a preliminary operating station to a filling station. An intermittent rotary mechanism sequentially aligns accommodating holes in the capsule body loading board with a filling nozzle for dispensing the viscous substance into the gelatin capsules.

9 Claims, 4 Drawing Figures

APPARATUS FOR FILLING VISCOUS SUBSTANCES INTO HARD GELATIN CAPSULES

BACKGROUND AND SUMMARY OF THE INVENTION

The present invention generally relates to a capsule filling machine and more particularly, to an apparatus for filling viscous substances into hard gelatin capsules.

As is generally known, gelatin capsules, for example, for use in pharmaceutical industry are classified into hard capsules and soft capsules, and commonly, powdered or granular substances are filled into the hard capsules each composed of a cylindrical open-ended body and a cap similar in shape to the body and applied onto the body with the open end of said body inserted into said cap, while oily substances in liquid forms are filled into the soft capsules so as to be respectively utilized as useful medicines.

As compared with the solid medicines such as powdered or granular medicines, the liquid medicines generally have such advantages as easiness in uniform dispersion of the active component in a carrier employed and precise distribution of the mixture obtained. However, even if the liquid medicine is filled as it is into the hard capsules, it undesirably leaks from the coupling portion between the body of the capsule and the cap thereof, and therefore, such a hard capsule is not suitable for practical application in the above case. Although a band seal applied onto the periphery of the coupling portion of the body and cap may prevent leakage of the liquid medicine, an extra operation is required during the filling process, thus resulting in unfavorable rise in manufacturing cost.

For such reasons, the liquid medicine has been inevitably filled into soft capsules. However, since special apparatuses are required for the production of the soft capsule-contained medicines, the manufacture of such soft capsule-contained medicines is normally performed by the so-called outside contract manufacturers, instead of being effected by the pharmaceutical company, thus presenting a new problem in the aspect of processing.

Due to the recent remarkable progress in the studies for prescriptions of the contents to be filled into the capsules, there has been developed a new medicine composition which has fluidity and viscosity and yet, may be filled into ordinary hard gelatin capsules without leakage, as disclosed, for example, in Japanese Laid Open Patent Application, Tokkaisho 54-80407. Thus, it is anticipated that the hard capsule-contained medicine filled with viscous substances will soon be put into practical use, but no capsule packing machines employed therefor up to the present have been fully satisfactory for the purpose. Accordingly, development of a new capsule filling machine for viscous substances has been strongly desired in this line of trade, and the present invention is provided to meet such requirements.

For the viscous substances suitable for filling into hard capsules, it is required to have a proper fluidity in terms of the operational efficiency during the filling and to cake or gel after the filling so as to prevent its leakage from the capsule.

The composite substance having such physical properties is fully disclosed in the aforesaid Japanese Laid Open Patent Application, and in short, is water soluble and thermally fusable substance having a caking point ranging from 20° to 60° C. and/or thixotropic gel. When the above substance is filled into hard capsules, there is employed a method in which the substance is filled while being heated, and then cooled at room temperature after the filling so that it may cake, or a method in which it is filled while being agitated so as to increase its fluidity in terms of the thixotropy of and then external force is removed after the filling so that it may gel. The apparatus for embodying such a filling method as described above is required to be specially arranged, taking into consideration the characteristics of the viscous substance to be filled and also particular structure of the hard gelatin capsule as a filling container.

Accordingly, an essential object of the present invention is to provide an apparatus which is capable of filling viscous substances into hard gelatin capsules in an efficient manner.

Another important object of the present invention is to provide an apparatus of the above described type which is simple in construction and accurate in functioning at high reliability, and can be readily manufactured at low cost.

In accomplishing these and other objects, according to one preferred embodiment of the present invention, there is provided an apparatus for filling viscous substances into hard gelatin capsules which includes a hopper member capable of storing viscous substance to be filled at a predetermined temperature and under agitation, a pumping mechanism which is communicated with the bottom portion of said hopper member and is kept at the same constant temperature as that of said hopper member, and is equipped with a filling nozzle means capable of weighing and discharging the viscous substance to be filled by a predetermined amount at a predetermined cycle, a capsule body loading board which can align and accommodate, in capsule body accommodating holes formed therein, a plurality of hard capsule bodies into which the viscous substance is to be filled, a reciprocating feed mechanism for the capsule body loading board, which transfers said capsule body loading board from a preliminary operating station to a filling station and returns said capsule body loading board back to the preliminary operating station again after completion of the filling, and an intermittent rotary mechanism for the capsule body loading board, which causes said capsule body accommodating holes formed in said capsule body loading board to correspond to the filling cycle of the pumping mechanism at said filling station thereby to sequentially align said accommodating holes with said filling nozzle means.

By the arrangement according to the present invention as described above, an improved apparatus for filling viscous substances into hard gelatin capsules has been advantageously presented, with substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
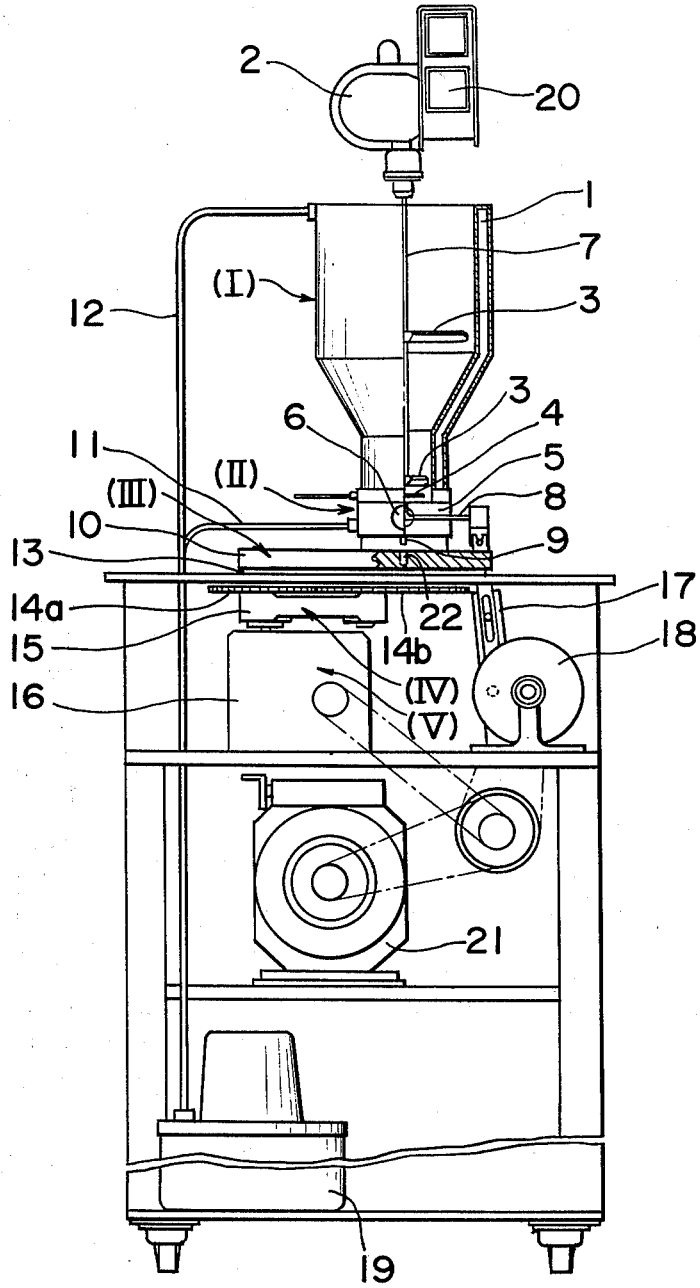
FIG. 1 is a side elevational view partly in section, showing the entire construction of an apparatus for filling viscous substances into hard gelatin capsules according to one preferred embodiment of the present invention.

Before the description of the present invention proceeds, it is to be noted that like parts are designated by like reference numerals throughout several views of the accompanying drawings.

In the first place, it is to be noted that the present invention relates to an apparatus for filling viscous substances into hard gelatin capsules, which includes, as indispensable construction requirements, a hopper which can store the viscous substance to be filled at a given temperature and under agitation, a pumping mechanism which is communicated with the bottom portion of the hopper and is kept at the same constant temperature as that of the hopper, and is equipped with filling nozzles capable of weighing and discharging the viscous substance to be filled by a predetermined amount at a predetermined cycle, a capsule body loading board which can align and accommodate, in capsule body accommodating holes formed therein, a plurality of hard capsule bodies into which the viscous substance is to be filled, a reciprocating feed mechanism for the capsule body loading board, which transfers the capsule body loading board from a preliminary operating station to a filling station and returns it back to the preliminary operating station again after completion of the filling operation, and an intermittent rotary mechanism for the capsule body loading board, which causes said capsule body accommodating holes formed in the capsule body loading board to correspond to the filling cycle of the pumping mechanism at the filling station so as to sequentially align them with the filling nozzles.

Referring now to the drawings, there is shown in FIG. 1 an apparatus for filling viscous substances into hard gelatin capsules according to one preferred embodiment of the present invention, which generally comprises:

(a) a hopper (I) which can store the viscous substance to be filled at a predetermined temperature and under agitation, (b) a pumping mechanism (II) which is communicated with the bottom portion of the hopper (I) and is kept at the same constant temperature as that of the hopper (I), and is equipped with filling nozzles capable of weighing and discharging the viscous substance to be filled by a fixed amount at a predetermined cycle, (c) a capsule body loading board (III) which can align and accommodate, in capsule body accommodating holes formed therein, a plurality of hard capsule bodies into which the viscous substance is to be filled, (d) a reciprocating feed mechanism (IV) for the capsule body loading board, which transfers the capsule body loading board from a preliminary operating station to a filling station and returns it back to the preliminary operating station again after completion of the filling, and (e) an intermittent rotary mechanism (V) for the capsule body loading board, which causes said capsule body accommodating holes of the capsule body loading board to correspond to the filling cycle of the pumping mechanism at the filling station so as to sequentially align them with the filling nozzles.

More specifically, the hopper (I) is composed of a double-wall hopper jacket 1, the bottom portion of which is communicated with the pumping mechanism (II) (to be described more in detail later). Circulating pipes 11 and 12 for water-supply and drainage, respectively, are provided at the approximately upper and lower ends within the hopper jacket 1, and communicated with each other through a thermostatic circulating water tank 19 disposed within the frame of the apparatus. The hopper (I) is further provided with an agitator 2, which is mounted at the top portion of the apparatus and arranged to uniformly stir the viscous substance accommodated in the hopper by agitating blades 3 coupled thereto by a shaft 7 extending into the hopper (I). As shown in FIG. 1, the agitating blades 3 should preferably be provided in plurality at least in two stages at the upper and lower levels of the hopper (I).

As described earlier, since the viscous substance to be filled into the hard capsules has thixotropy and/or thermally fusing property, viscosity variation thereof tends to be large due to stirring condition within the hopper or set temperature of the hopper, and therefore precise control of the substance to be filled is required before and during the filling. Accordingly, the hopper (I) in the apparatus of the present invention having the construction as described so far is so arranged that the temperature of the viscous substance to be filled accommodated in the hopper is detected by a temperature sensing element 4 disposed at the lower portion of the hopper jacket 1, and the value of the temperature thus detected proportionally controls the functioning of a heater (not shown) for the thermostatic circulating water-tank 19 through a controller (not shown). The hot water controlled in its temperature in the above described manner is fed to the hopper jacket 1 through the pipe 11 to heat the viscous substance contained within the hopper (I). Thereafter, the hot water is returned again to the thermostatic circulating water-tank 19 through the pipe 12. Such operations described above are repeated to control the viscous substance in the hopper (I) at a constant temperature.

On the other hand, the number of revolutions of the agitator 2, the resistance forces applied to the agitating blades 3, etc. are indicated by a meter 20 mounted on the agitator 2, so that the rheology nature of the viscous substance can be observed and confirmed at all times.

When the predetermined temperature and uniform stirring are available with respect to the viscous substance contained in the hopper in the manner as described so far, the filling is performed while this condition is being maintained.

Figure 2:
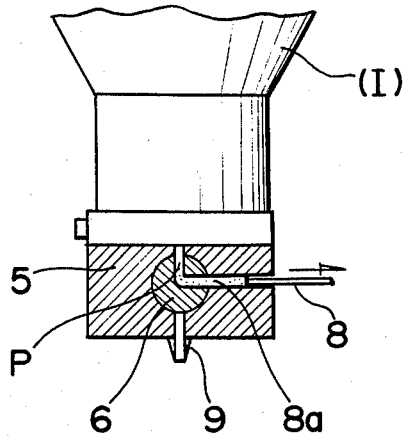
FIGS. 2 and 3 are fragmentary side elevational views showing, on an enlarges scale and partly in section, the construction and operations of a pumping mechanism employed in the apparatus of FIG. 1.
Figure 3:
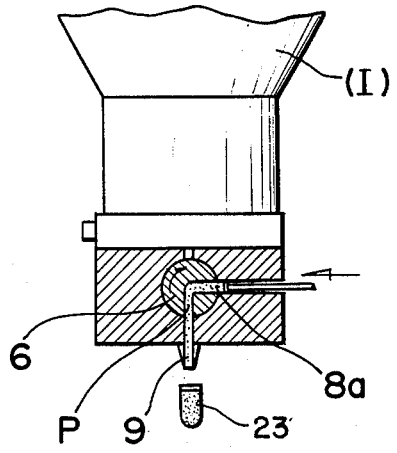

The filling of the viscous substance is effected by the pumping mechanism (II). The pumping mechanism is composed of a pumping box 5, a sub-station roller 6, a piston 8 and at least one filling nozzle 9, which are integrally communicated with the bottom portion of the hopper 1, and are maintained at the same constant temperature as that of the hopper. The specific construction and operation of the pumping mechanism (II) are illustrated in FIGS. 2 and 3. The pumping mechanism itself is already known as disclosed, for example, in Japanese Patent Publications; Tokkosho 48-41674 and 49-39157, and Japanese Laid Open Utility Model Application, Jikkaisho 54-113842. Accordingly, the detailed description of the pumping mechanism will be abbreviated here for brevity. However, in short, the arrangement is such that, through 90° rotation of the sub-station roller 6, the end openings of an L-shaped passage P, which is formed in the roller, are arranged to be communicated (FIG. 2, during the suction of a fixed amount of the viscous substance), respectively, with the hopper (I) and a cylinder 8*a* (a reciprocation bore for the piston 8), or to be communicated (FIG. 3, during the filling operation) with the cylinder 8*a* and the filling nozzle 9. It is advantageous in terms of treatment performance to provide a plurality of filling nozzles 9 and pistons associated therewith as in the foregoing embodiment.

As described hereinabove, the pumping mechanism (II) draws in and discharges a fixed amount of the viscous substance through the reciprocating operation of the piston 8 and changes the flow passage P through the reverse-rotation of the sub-station roller 6 adjusted in timing to the operation of the piston 8 thereby to fill the previously sucked fixed amount of viscous substance from the filling nozzle 9 into the body 23 of the hard capsule. The adjustment of the filling amount of the viscous substance is performed through adjustment of the stroke of the piston 8, while the reciprocating operation of the piston 8 is effected by crank mechanisms 17 and 18 having a main motor 21 as a driving source. Needless to say, the crank mechanisms may be replaced by, for example, a cam mechanism, if required.

Figure 4:
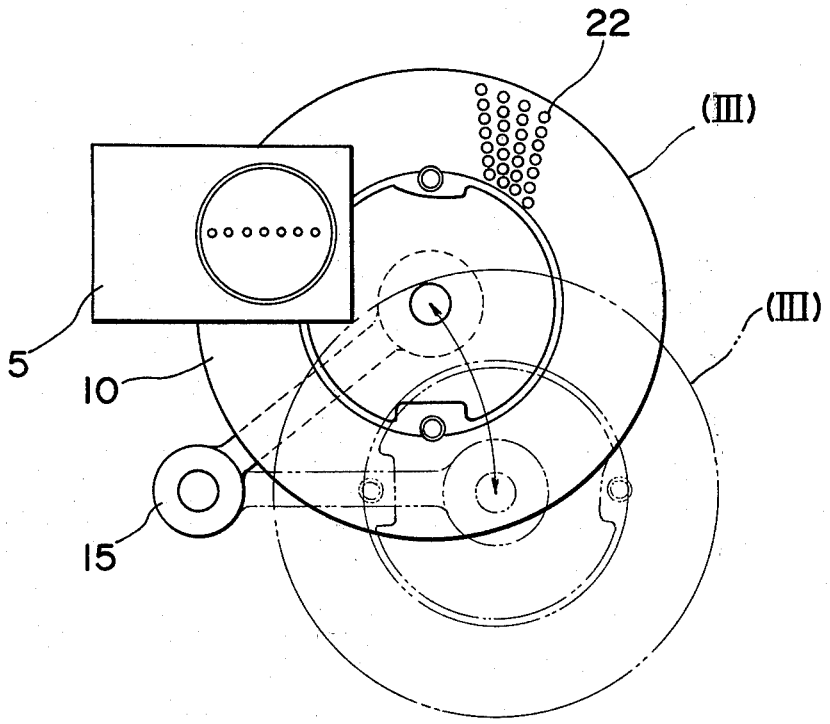
FIG. 4 is a schematic diagram explanatory of operation of a reciprocating feed mechanism of a capsule body loading board employed in the apparatus of FIG. 1.

The capsule body loading board (III) is made of a disc 10, which is slightly thicker than the length of the body 23 of the hard capsule, into which the viscous substance is filled, with numerous capsule body accommodating holes 22 being regularly formed in the top face of the disc 10. The accommodating holes 22 may be aligned along the radial direction of the disc 10, but it is preferable to arrange the holes 22 to be eccentric with respect to the disc 10 as illustrated in FIG. 4, since more accommodating holes 22 may be provided. In this case, it is needless to say that the filling nozzles 9 are required to be aligned with the disposing arrangement of the capsule body accommodating holes 22.

The capsule body loading board (III) is detachably placed on the index table 13 of a reciprocating feed mechanism (IV) for said loading board (III) and is reciprocated, together with the index table 13, between the preliminary operating station and the filling station through the operation of the feed mechanism (IV). The reciprocating feed mechanism (IV) for the loading board (III) is composed of an arm 15 which is pivotably fitted, at its one end, over the output shaft of the index unit 16, a pivoting mechanism (not shown) with respect to the arm 15 and an index table 13 supported by a shaft provided at the other end of the arm 15. The specific operation of the feed mechanism of the body loading board will be described later.

The index table 13 is initially positioned at the preliminary operating station, which is indicated by chain lines in FIG. 4. In this position, the capsule body loading board (III) accommodating therein the capsule bodies 23, into which the viscous substance is to be filled, is fixedly placed on the table 13. Then, an arm pivoting mechanism (not shown) is started to cause the arm 15 to pivot, to a predetermined circumferential angle, about the output shaft of the index unit 16, and transfers the capsule body loading board (III), together with the index table 13 supported by a shaft provided at the other end of the arm 15, to a predetermined position, i.e., to the filling station located directly below the pumping mechanism (II) as shown by solid lines in FIG. 4. In the illustrated embodiment, the preliminary operating station is flush with the filling station, so that the body loading board (III) is arranged to be transferred horiziontally on the plane, but depending on necessity, it is possible to modify the direction of transfer into a vertical direction. However, the horizontal transfer of the capsule body loading board (III) as in the illustrated example is desirable in terms of mechanism and working efficiency.

When the capsule body loading board (III) is transferred to the filling station as described hereinabove, the intermittent rotary mechanism (V) for the loading board (III) starts its operation to sequentially align the capsule body accommodating holes 22 of the loading board (III) with the fitting nozzle 9 through correspondence to the filling cycle of the pumping mechanism (II). As described hereinabove, the intermittent rotary mechanism (V) of the loading board (III) is always arranged to be synchronized in operation with the pumping mechanism (II), so that the filling operation of the viscous substance into the capsule body is effected in accordance with the intermittent rotation of the capsule body loading board (III).

The intermittent rotary mechanism (V) for the capsule body loading board (III) is composed of the known index unit 16 which can be operated by the main motor 21, and a small gear 14*a* and a large gear 14*b* which can transmit the output of the unit to the index table 13. The index table 13 is fitted over the rotary shaft of the large gear 14*b*. Accordingly, the intermittent rotation of the index unit 16 through operation of the main motor 21 is transmitted to the index table 13 through the gears 14*a* and 14*b*, and thus, the loading board (III) secured onto the index table 13, also, starts its intermittent rotation simultaneously at a predetermined pitch. The pitch of the intermittent rotation is of course determined by the number of the arrangements of the capsule body accommodating holes 22 in the loading board (III). In the illustrated embodiment, since the capsule body accommodating holes 22 are formed in 60 separate rows on the circumference of the loading board (III), said loading board (III) performs its intermittent rotation, while receiving the viscous substance from the filling nozzle at a pitch of 1/60 rotation. Accordingly, the capsule body loading board (III) makes one rotation through intermittent rotation of 60 times, and thus, the predetermined amount of viscous substance is filled into many capsule bodies 23 accommodated in the loading board (III) to complete the filling operation. The number of the intermittent rotations of the capsule body loading board (III) is counted by a suitable mechanical, electric or optical means (not shown) so as to detect the completion of one cycle of the filling. In the illustrated example, one rotation of the loading board (III) itself is confirmed when the number of the intermittent rotations has reached 60 or when a proper reference mark marked on the loading board (III) itself has been read by a suitable means. Similarly the completion of such one cycle of filling may be automatically judged also by directly counting the number of filling functionings of the piston 8 in the pumping mechanism.

When the filling operation has been completed in the manner as described above, the arm pivoting mechanism (not shown) is operated by a relay to pivot the arm 15, in the direction opposite to the above, about the output shaft of the index unit 16 to return the index table 13 and the loading board (III) again from the filling station to the position of the preliminary operating station shown by the chain lines in FIG. 4.

Various means may be specifically adopted for the pivoting mechanism of the arm 15. Although not particularly shown, it may be so arranged, for example, that a nut-like actuator is engaged with a screw rod rotatably provided for rotation in forward and reverse directions, with the actuator being connected with the arm 15 by a link mechanism. In this case, the arm 15 can be easily pivoted through rotation of the screw rod in the forward or reverse direction. Thus, the transfer of the loading board (III) from the preliminary operating station to the filling station, starting of the filling, and returning of the loading board (III) to the preliminary operating station after completion of the filling, are automatically performed, if another motor for rotating the screw rod is installed, with a starting switch therefor, a main switch for operating the apparatus and the filling completion detecting mechanism being suitably relayed in functionings.

Upon returning of the capsule body loading board (III) to the preliminary operating station after completion of the filling operation, the loading board (III) is removed from the index table 13 in this position, and subsequently, caps are combined, respectively, with the capsule bodies 23 filled with the viscous substance to provide filled capsules (capsule contained-medicine). Although the above operation is normally performed manually, if a corresponding capsule cap loading board is provided as in the capsule body loading board (III) described so far, so as to be coaxially superposed on the body loading board (III) after completion of the filling for depression of the closed ends of the respective capsule bodies and/or caps, a large number of capsules may be assembled at one time, and thus the combination or assembly of the bodies with the caps is extremely efficiently effected.

The apparatus of the present invention has such construction and functions as described in detail hereinabove, and is particularly characterized in the following points.

(1) Since the index table is arranged to be reciprocated between the preliminary operating station and the filling station, the capsule body loading board may be mounted or dismounted at the preliminary operation station, thus resulting in not only easier and safer operations, but also improved efficiency of the filling operation.

(2) Since the body loading board is arranged to be transferred to the filling station in the manner as in the above item (1), the nozzle may remain fixed, thus resulting in simplified mechanism of this portion and advantageous maintenance of the apparatus.

(3) Since the apparatus of the present invention is of a semi-automatic type wherein the mounting and dismounting of the capsule body loading board on and from the index table, respectively, are manually performed, the failure in loading the capsule bodies into the capsule body loading board may be preliminarily detected, whereby the various problems during the loading can be prevented in advance.

(4) Since the apparatus of the present invention is of such a semi-automatic type as described hereinabove, it is ideal for manufacturing comparatively a small amount of capsule-contained medicines in a large variety such as medical supplies for clinical examination use. In addition, a plurality of filling nozzles, if provided, remarkably increase the filling capacity, so that the apparatus of the present invention is particularly suitable for general mass production purposes.

(5) The apparatus of the present invention is extremely advantageous for practical use, since the apparatus is entirely simplified in construction, reliable in operation and inexpensive.

It is to be noted here that, for complete elimination of any possibility that the content of the capsule in the liquid form should ooze out from the fitting portion between the body and cap portion of the capsule with the lapse of time, it may further be so arranged that a suitable sealing agent is filled into a remaining space of the capsule body having contents accommodated therein, and thereafter, the cap is applied onto the body.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An apparatus for filling viscous substances into hard gelatin capsules, comprising:

(a) a hopper member capable of storing viscous substance to be filled at a predetermined temperature and under agitation, (b) a pumping mechanism which is communicated with the bottom portion of said hopper member and is kept at the same constant temperature as that of said hopper member, and is equipped with filling nozzle means capable of weighing and discharging the viscous substance to be filled by a predetermined amount at a predetermined cycle, (c) a capsule body loading board which aligns and accommodates, in capsule body accommodating holes formed therein, a plurality of hard capsule bodies into which the viscous substance is to be filled, (d) a reciprocating feed mechanism for the capsule body loading board, which transfers said capsule body loading board from a preliminary operating station to a filling station and returns said capsule body loading board back to the preliminary operating station again after completion of the filling, and (e) an intermittent rotary mechanism for the capsule body loading board, which causes said capsule body accommodating holes formed in said capsule body loading board to correspond to the filling cycle of the pumping mechanism at said filling station thereby to sequentially align said accommodating holes with said filling nozzle means;

said reciprocating feed mechanism for the capsule body loading board further including an arm member associated with a pivoting mechanism therefor, and pivotally fitted, at its one end, over an output shaft of an index unit driven by a motor, and pivotally supporting, at its other end, an index table on which said capsule body loading body is detachably mounted for transferring said capsule body loading board between said preliminary operating station and said filling station.

2. An apparatus as claimed in claim 1, wherein said hopper member includes an agitator having blade means for stirring the viscous substance contained therein.

3. An apparatus as claimed in claim 1, wherein said pumping mechanism further includes a pumping box communicated with the bottom portion of said hopper member, and having said filling nozzle means, cylinder bore means in which piston means is reciprocatingly accommodated, and a roller member which is rotatably accommodated in said pumping box and which has passage means of the viscous substance formed therein for selective communication, at opposite ends thereof, with said hopper member and cylinder bore means or with said cylinder bore means and said filling nozzle means upon rotation of said roller member.

4. An apparatus as claimed in claim 3, wherein said filling nozzle means is a plurality of filling nozzles, said piston means being piston members reciprocatingly accommodated in cylinder bores for said cylinder bore means corresponding in number with said filling nozzles.

5. An apparatus as claimed in claim 4, wherein said piston members are arranged to be reciprocated in said cylinder bores through a crank mechanism associated with a motor.

6. An apparatus as claimed in claim 4, wherein said piston members are arranged to be reciprocated in said cylinder bores through a cam mechanism.

7. An apparatus as claimed in claim 1, wherein said capsule body accommodating holes formed in said capsule body loading board are aligned in a radial direction of said capsule body loading board.

8. An apparatus as claimed in claim 1, wherein said capsule body accommodating holes formed in said capsule body loading board are aligned to be eccentric with respect to said capsule body loading board.

9. An apparatus as claimed in claim 1, wherein said intermittent rotary mechanism includes an index unit driven by a motor, and a gear train for transmitting the output of said index unit to an index table which is mounted onto a rotary shaft of one of the gears of said gear train so as to transmit the intermittent rotation of said index unit resulting from driving of said motor to said index table through said gear train for simultaneous intermittent rotation of said capsule body loading board at a predetermined pitch.

* * * * *